United States Patent [19]

Honegger

[11] 4,010,529

[45] Mar. 8, 1977

[54] METHOD AND APPARATUS FOR TREATING YARNS

[75] Inventor: Aldo Honegger, Venissieux, France

[73] Assignee: Rhone-Poulenc-Textile, Paris, France

[22] Filed: Dec. 22, 1975

[21] Appl. No.: 643,482

[30] Foreign Application Priority Data

Dec. 23, 1974 France ..... 74.42812

[52] U.S. Cl. ..... 28/1.2; 28/72.1

[51] Int. Cl.[2] ..... D02G 1/00

[58] Field of Search ..... 28/1.2, 62, 72 HR, 72.1, 28/75 WT, 76 R

[56] References Cited

UNITED STATES PATENTS

| | | | |
|---|---|---|---|
| 3,080,736 | 3/1963 | Mabru et al. | 28/1.2 X |
| 3,408,716 | 11/1968 | Tradewell | 28/62 |
| 3,644,968 | 2/1972 | Elliott et al. | 28/1.2 |
| 3,701,182 | 10/1972 | Gasser et al. | 28/62 X |
| 3,785,017 | 1/1974 | Jacob et al. | 28/72 HR |

*Primary Examiner*—Louis K. Rimrodt
*Attorney, Agent, or Firm*—Sherman & Shalloway

[57] ABSTRACT

A yarn treatment unit including a tubular body having a helical groove on its inner surface and a plurality of orifices opening in the groove to impact a treating fluid on the yarn as it passes along the groove. The yarn preferably is presented to the treatment unit pneumatically and traverses the unit without applied tension along its length.

5 Claims, 7 Drawing Figures

METHOD AND APPARATUS FOR TREATING YARNS

BACKGROUND OF THE INVENTION

The present invention relates to the treatment of yarns and concerned, more particularly, with the treatment of yarns without contact with the surface of the treating unit and without applied tension on the yarn as it is undergoing treatment.

BRIEF DESCRIPTION OF THE PRIOR ART

Yarn-treatment installations typically have involved the use of large areas and space, especially when substantial lengths of time are required for the treating process.

For certain types of treatment, the yarn is drawn across heated surfaces to deliver heat to the yarn. However, the frictional drag of the yarn against the surface and the resultant tensioning during the treatment can cause an undesirable stretching of the yarn and a high degree of shrinkage in subsequent processing or use.

Furthermore, prior contact-treatment sytems have been unable to effect a uniformity of treatment of yarns since only a small portion of the yarn is in contact with the heated surface, while the remainder of the circumference of the yarn is out of contact and is exposed to the surrounding atmosphere.

A recent improvement in yarn treatment is disclosed in commonly assigned U.S. Pat. Application Ser. No. 583,914 filed Jun. 5, 1975 and titled Process and Apparatus for Treating Filamentary Yarns. The yarn is passed along grooves on the exterior of a cylinder and is subjected to blasts of treating fluid from orifices which open into the grooves from the inner portion of the cylinder. The yarn is thus floated in the jetted fluid and may be partially driven by the fluid.

This new approach to yarn treatment has been effective in the treatment of relatively stable yarns which are not adversely effected by tension. However, with more sensitive yarns having a high stretchability, which exhibit a high degree of elongation under tension, or which are crimped and subject to loss of their crimp, these treatment units have not been found to be completely satisfactory. The basic driving tension on the yarn is augmented by the centrifugal force of the yarn as it moves at high speeds about the grooved cylinder. The jets impose an additional radial or outward pressure against the yarn and thereby increase the tension along the yarn.

Accordingly, prior yarn-treating systems have not proven entirely satisfactory, especially with regard to yarns with characteristics which make it desirable to minimize or avoid tensioning during their treatment.

SUMMARY OF THE INVENTION

In general, the preferred form of yarn treatment unit of the present invention comprises a body having a generally cylindrical passage therethrough. The inner wall of the passage has a spiral groove formed therein to form a spiral yarn path within the path and has a plurality of fluid apertures located at spaced points in and along the groove and directed at least partially radially to support the yarn in the groove without contact with the walls.

In general, the preferred method of the present invention comprises passing a yarn downwardly in a spiral path in a treatment zone, supplying a treating fluid to the treatment zone, and impacting the treating fluid inwardly against the yarn spiral to oppose the tensioning forces on the yarn.

OBJECTS OF THE INVENTION

It is an object of the present invention to provide a yarn treating system which is compact and provides a substantial duration of treatment.

It is another object of the present invention to provide a compact yarn treating system which imposes a minimum of elongating stress upon the yarn.

It is another object of the present invention to provide a compact yarn-treating system which treats yarns at high linear speeds with a minimum of tension on the yarn.

It is a further object of the present invention to provide a compact yarn-treating system which treats the yarn in a tortuous path at high linear speeds and which employs fluid jets along the tortuous path to oppose inertial forces in the yarn.

A further object of the present invention is the provision of a compact yarn-treating system which treats the yarn in a descending spiral path at high linear speeds and employs treating-fluid jets along the spiral path and directed to oppose centrifugal forces in the moving yarn.

BRIEF DESCRIPTION OF THE DRAWINGS

These and other objects of the invention and a better understanding thereof may be derived from the following description and the accompanying drawings in which.

DETAILED DESCRIPTION OF THE PREFERRED EMBODIMENT

Figure 1:
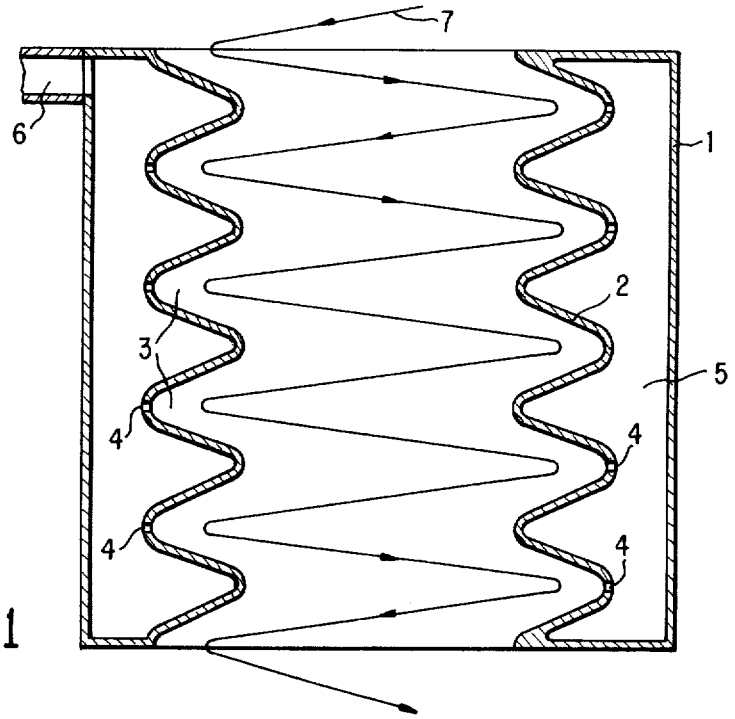
FIG. 1 is a partly-schematic sectional elevation of the preferred form of treating unit.
Figure 2:
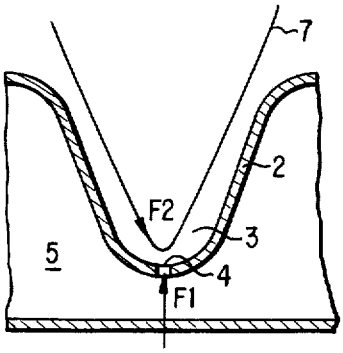
FIG. 2 is an enlarged view of a portion of FIG. 1.
Figure 3:
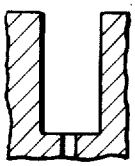
FIG. 3 is a view similar to a portion of FIG. 2 and showing a modified form of yarn-path groove.
Figure 4:
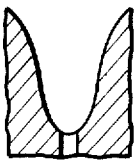
FIG. 4 is a view similar to FIG. 3 and showing a further modified form of yarn-path groove.
Figure 5:
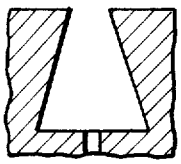
FIG. 5 is a view similar to FIG. 3 and showing a further modified form of yarn path groove.
Figure 6:
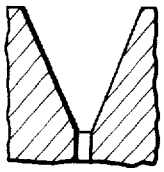
FIG. 6 is a view similar to FIG. 3 and showing a further modified form of yarn-path groove.
Figure 7:
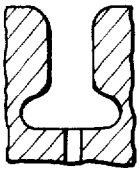
FIG. 7 is a view similar to FIG. 3 and showing a further modified form of yarn-path groove.

As shown in FIG. 1 and 2, the preferred form of yarn-treating unit of the present invention comprises a body having an outer casing 1 and an inner casing 2. The inner casing has a spiral groove 3 on its inner wall which forms a passageway for yarns to be treated.

The spiral groove 3 has perforations of jet apertures 4 distributed at intervals along its length and preferably directed radially inwardly as indicated by the arrow F1 to oppose the centrifugal force, indicated by the arrow F2 acting upon the yarn in the spiral pathway.

It is to be understood, however, that the apertures 4 may be directed other than truly radially as long as they permit sufficient radial force to oppose the inertial force of the rotating yarn turns. Preferably, each turn of the helical groove is provided with four evenly distributed apertures although more or fewer apertures may be suitable for certain treatments, yarn-speeds or other variable conditions.

The outer casing 1 and inner casing 2 form a plenum chamber 5 in communication with the apertures 4 and which receives a treatment fluid via an inlet 6. The treating fluid may be a gas, liquid, a vapor or a mixture thereof. Suitable liquids would include, for example, dyes, oils or water. The treating fluid may contain solids for treatment or deposition on the yarn, where desired, and is heated or controlled in temperature by any conventional means, not shown.

The cross-sectional shape of the groove 3 may take any desired shape, as is apparent in FIGS. 3 through 7, with the size of the deepest part of the groove being at least equal to the diameter of the yarn to be treated.

The apertures 4 may be provided in any desired number, shape and direction. Further, the number of apertures per turn may be varied along the length of the groove. With modifications, different treating fluids or fluids having different treating characteristics may be supplied through different apertures. Also, plural treating units may be successively associated with each other to effect prolonged treatment or different, sucessive treatments.

Although a generally cylindrical passageway through the unit is preferred, it is to be understood that the inner wall 2 may be tapered and may be a polygon approaching a circle in cross-section.

Operation of the Preferred Embodiment

In operation of the unit in the process of the invention, a yarn 7 is fed into the groove 3 at high speed by a suitable unit (not shown) which preferably is a pneumatic-transport nozzle or feeder.

A treating fluid under pressure is supplied through the inlet 6 to the plenum 5 and emerges as jets via the aperture 4 along the yarn path groove 3. The yarn is thus turned and supported in the groove 3 by the fluid jets.

The pressure of the treating fluid supplied is adjusted, as required, to accommodate variables of the treating process, the speed of the yarn through the unit, so that the inward radial force F1 of the jets provides a balance against the outward force of the rotating yarn, thereby counteracting the stretching or tensioning forces on the yarn.

The treatment of the yarn may be any desired process including, for example, stabilizing, heat treatment, relaxing, sizing or oil treatment, fixing, cooling, dyeing, coating and the like.

The yarns which may be so treated may be any continuous yarn including, for example, fibrous threads, roves, whether crimped or stuffed, and including artificial and synthetic materials.

Where heat treatment of the yarn is included, the lack of yarn tension provided by the present invention is particularly advantageous in regard to the structural integrity of the yarn. Further, the lack of tensioned elongation during the treating process produces a treated yarn of minimal residual shrinking, since the yarn is free to shrink during the treatment. This is particularly important in treating compound synthetic yarns which have been crimped.

EXAMPLE 1

A latent-crimping, bilaminar compound yarn of diethylene glycol polyterephthalate and butylene glycol polyterephthalate reticulated with 0.3 mol% of trimethylol propane, as disclosed in French patent application 72/16921 filed May 4, 1972, now French Pat. No. 2,182,766 was heat-slackened or relaxed in conjunction with its extrusion-drawing to 180 dtex/32 strands.

The yarn treating unit was in accordance with that disclosed in FIG. 1 and of the following specifications:

| | |
|---|---|
| length of unit | 200mm |
| groove diameter | 137mm |
| groove depth | 15mm |
| groove turns | 20 spirals |
| apertures | 4 per turn |

The drawn yarn was fed to the yarn-treating unit by a pneumatic traction nozzle at 2300 meters/minute. Saturated steam at 102° C and 300g/cm² was supplied to the plenum, and treated yarn discharged at 2000 meters/minute.

The treated yarn exhibited uniform crimping and, most significantly, almost zero residual shrinking at 100° C in steam. The original, drawn yarn exhibited a shrinkage rate of 13% but the yarn after treatment exhibited only 0.8%. Further, the drawn yarn had 5.2 half-waves/cm of crimp and, after treatment, had 21 half-waves/cm.

EXAMPLE 2

A yarn similar to that of Example 1 was treated in the same unit and under the same conditions, except that it was supplied to the unit at the rate of 3300 meters/minute and discharged at 2940 meters/minute.

The treated yarn had a residual shrink rate of 1%, in 100° C steam. The crimp effect produced 20 half-waves/cm from an original of 5.6 half-waves/cm in the drawn yarn.

It is significant to note that the treatment unit employed in examples 1 and 2 was capable of containing a length of 8.4 meters of yarn, in spite of its compact size.

Therefore the yarn-treating method and apparatus of the present invention provides effective treatment of yarns at high speeds and in a minimum of space while, at the same time, it improves the stability of the yarn, in terms of residual shrinkage, by minimizing or avoiding yarn-tension during the treatment.

Various changes may be made in the details of the invention as disclosed without sacrificing the advantages thereof or departing from the scope of the appended claims.

What is claimed is:

1. A method for treating textile yarn comprising a. passing a yarn along a spiral groove in a treatment zone;

b. supplying a treating fluid to the treatment zone, and c. impacting the treating fluid inwardly against the yarn spiral to oppose tensioning forces on the yarn.

2. The method of claim 1 in which the yarn is passed in a downward spiral.

3. The method of claim 2 in which the treating fluid is directed substantially radially against the yarn spiral.

4. A yarn-treatment unit comprising a. a body having b. a yarn passage therethrough, said passage including c. a spiral yarn path which is defined, at least in part by a spiral groove in said passage, d. a plurality of apertures directed inwardly toward said spiral yarn path, e. means for supplying a yarn to said yarn path, and f. means for supplying a treating fluid through said apertures and against the yarn in said yarn path.

5. The yarn-treatment unit of claim 4 in which said apertures open substantially radially into the bottom of said spiral groove.

* * * * *